United States Patent [19]

Kamei et al.

[11] Patent Number: 4,854,891

[45] Date of Patent: Aug. 8, 1989

[54] CONNECTOR BACKSHELL STRUCTURE

[75] Inventors: Takeo Kamei; Katsuyuki Sekine, both of Iruma, Japan

[73] Assignee: Yokogawa Aviation Company, Ltd., Iruma, Japan

[21] Appl. No.: 238,601

[22] Filed: Aug. 30, 1988

[30] Foreign Application Priority Data

Sep. 9, 1987 [JP] Japan ..... 62-225970

[51] Int. Cl.[4] ..... H01R 13/59; H01R 13/658

[52] U.S. Cl. ..... 439/462; 439/610

[58] Field of Search ..... 439/98, 99, 610, 461, 439/462, 805, 807, 784, 797, 863

[56] References Cited

U.S. PATENT DOCUMENTS

| | | | |
|---|---|---|---|
| 2,331,409 | 10/1943 | Markey | 439/461 |
| 3,448,430 | 6/1969 | Kelly | 439/610 |
| 4,165,911 | 8/1979 | Laudig | 439/314 |
| 4,566,745 | 1/1986 | Maros | 439/98 |
| 4,671,598 | 6/1987 | Keehne | 439/610 |
| 4,784,141 | 11/1988 | Peers-Traverton | 439/784 |

FOREIGN PATENT DOCUMENTS

| | | | |
|---|---|---|---|
| 2109648 | 6/1983 | United Kingdom | 439/610 |

*Primary Examiner*—Gary F. Paumen

*Attorney, Agent, or Firm*—Moonray Kojima

[57] ABSTRACT

A connector backshell structure wherein a wedge-like ring having at least one slit extending along the entire longitudinal length thereof is used for holding a cable shield in tight contact with the tapered inner surface of the connector backshell, and a spring washer is used for elastically urging the ring toward the tapered surface with a cap nut pressing and fixing the spring washer to the open end of the backshell, whereby the contact between the cable shield and backshell is reliably maintained.

6 Claims, 3 Drawing Sheets

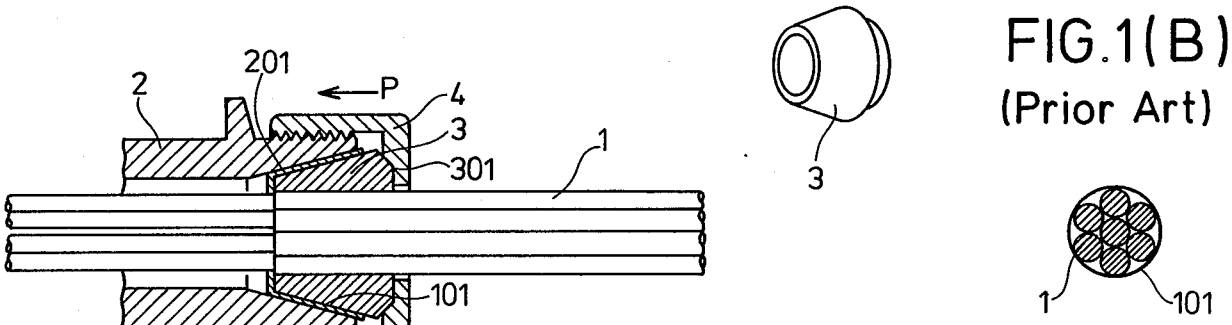
FIG.1(A)
(Prior Art)
FIG.1(C)
(Prior Art)
FIG.1(B)
(Prior Art)
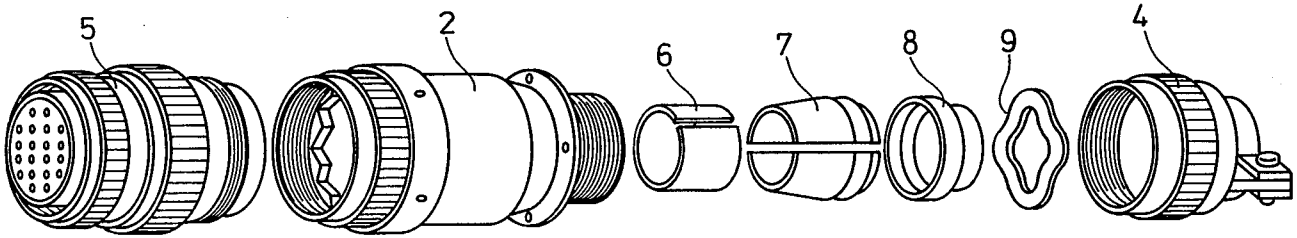
FIG.2

CONNECTOR BACKSHELL STRUCTURE

BACKGROUND OF THE INVENTION

1. Field of Invention

This invention relates to a connector backshell structure for connecting a connector backshell to the rear part of a connector to which a shielded cable is connected; and more particularly, to an improvement in the electrical contact structure between the shield of the cable and the connector backshell.

2. Description of Prior Art

FIGS. 1(A), 1(B) and 1(C) describe a prior art backshell structure, such as disclosed in U.S. Pat. No. 3,448,430. In FIGS. 1(A)–1(C), a connector backshell structure is shown comprising a cable 1, a shield 101 covering the outer periphery of cable 1 and a connector backshell 2 having an open end from which cable 1 passes therethrough with the inner periphery of the open end being provided with a tapered surface 201.

Shield 101 is peeled and bent outwardly of the outer periphery of cable 1 so as to keep tight contact with the whole of tapered surface 201 of connector backshell 2 and is cut to a suitable length.

A wedge-like metal ring 3, capable of slidably fitting about cable 1 with its tapered portion, engages tapered surface 201 of connector backshell 2 through cable shield 101.

A cap nut 4, which, when screw clamped, thrusts a bottom 301 of ring 3 in the direction of the opening of connector backshell 2 (the direction indicated by arrow P) so as to reduce electrical contact resistance between shield 101 and connector backshell 2.

However, the problems encountered with such conventional contact structure are that since connector backshell 2, ring 3, and cap nut 4 are integrally connected with one another and ring 3 is made of a rigid material, when cable shield 101 is subjected to vibrations, or a change occurs in the temperature, of the connector and backshell 2, a flaw, such as habitual deformation or crushing, tends to be generated in cable shield 101 so that contact between the tapered surface 201 of backshell 2 and the shield 101 becomes loosened. This hinders the cable shielding effect and electromagnetic waves from the cable would be released to the surrounding equipment.

SUMMARY OF THE INVENTION

Accordingly, an object of the invention is to provide a connector backshell structure which overcomes the above and other problems, deficiencies and disadvantages of the prior art.

The invention comprises a number of features which combined produce a novel backshell structure which provides mechanism for reliably securing the shield of the cable to the backshell connector. The invention comprises a connector backshell having an open end from which a cable covered with a shield passes therethrough with the inner periphery of the open end being tapered and the shield of the cable being bent outwardly of the outer periphery of the cable and thrust against the tapered surface; a wedgelike ring having at least one slit extending along the entire longitudinal length thereof for holding the shield in tight contact with the tapered surface; a spring washer for elastically pressing the ring against the tapered surface; and a cap nut for pressing and fixing the spring washer to the open end of the connector backshell.

Using the combination of the above elements of the invention, the cable shield is held in tight contact with the tapered surface of the open end of the connector backshell by means of the wedgelike ring, while the ring is resiliently pressed against the tapered surface by means of the spring washer, which is, in turn pressed and held stationary by the cap nut, which is screw threaded into the open end of the connector backshell.

BRIEF DESCRIPTION OF DRAWINGS

FIGS. 1(A), 1(B), and 1(C) are different views depicting a conventional connector backshell structure.

FIG. 2 is a perspective view of an illustrative embodiment of the invention.

DETAILED DESCRIPTION OF PREFERRED EMBODIMENTS

Figure 3B:
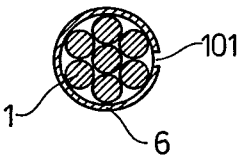
FIG. 3(B) is a sectional view of the cable arrangement used in connection with the embodiment of FIG. 2.
Figure 3A:
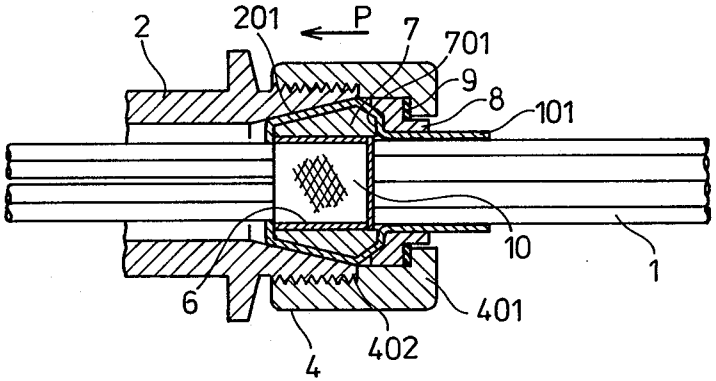
FIG. 3(A) is a sectional view of the embodiment of FIG. 2.

Turning now to the illustrative embodiment of FIG. 2 and FIGS. 3(A) and 3(B), the same parts as shown in FIG. 1 bear the same reference symbols and will not be further discussed hereat for sake of clarity. The embodiment comprises a connector 5, to which a connector backshell 2 is connected, a tube 6, a wedge-like ring 7, a stepped ring 8, a spring washer 9, and a knit mesh 10 (see FIG. 3(A)). These elements numbered 6 through 10, are all made of a metallic material, and ring 7 is, in this embodiment, split into two parts in the axial direction, as depicted. The ring 7 has at least one slit extending along the entire longitudinal length thereof, and may have more than one, such as shown in the other embodiments of FIGS. 4–6. The tube 6 has an axial direction slit, but, may also be a spiral shaped slit, as shown in FIG. 6.

The assembling of the depicted parts will now be described with reference to FIGS. 3(A) and 3(B). A portion of cable shield 101 facing tapered surface 201 of connector backshell 2 is peeled from cable 1, then metallic knit mesh 10 is wound around the exposed portion of cable 1 with a part of the peeled shield 101 being interposed therebetween and metallic tube 6 is fitted about knit mesh 10. Knit mesh 10 and tube 6 serve to secure contact with wedge-like ring 7. Wedge-like ring 7 is slidably fitted about tube 6 so that shield 101 is tightly clamped between tapered surface 201 and ring 7 which is also held in tight contact with tube 6.

Stepped ring 8 is loosely fitted about cable 1 so that the extended part of shield 101, clamped between ring 7 and tapered surface 201 of connector backshell 2, is clamped between ring 8 and bottom 701 of split ring 7.

Spring washer 9 fits on the stepped portion of ring 8 and is thrust in the direction designated by arrow P, by a collar 401 of cap nut 4, which is screw fitted about the peripheral end portion of connector backshell 2, as depicted. Due to the elastic force of spring washer 9, ring 7 is pressed against tapered surface 201 through stepped ring 8.

At the inner periphery of cap nut 4 there is formed a step 402. The screw clamping of cap nut 4 is regulated at a position whereat step 402 abuts against the open end of connector backshell 2. Thus, when cap nut 4 is held stationary after it has been clamped in the above-mentioned position, spring washer 9 is maintained in a state wherein it is about to be fully compressed for its designated function.

Figure 4:
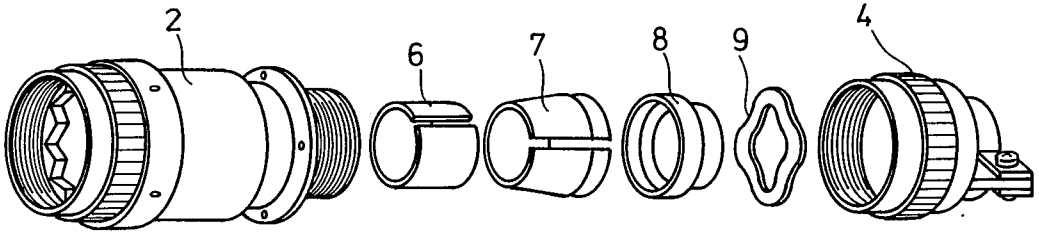
FIG. 4 is a perspective view of another illustrative embodiment of the invention.
Figure 5:
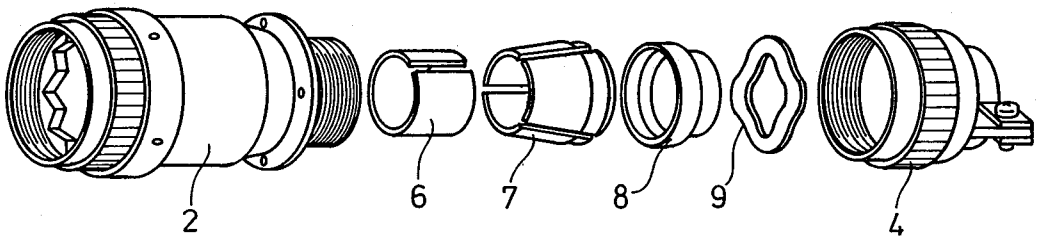
FIG. 5 is a perspective view of a further illustrative embodiment of the invention.
Figure 6:
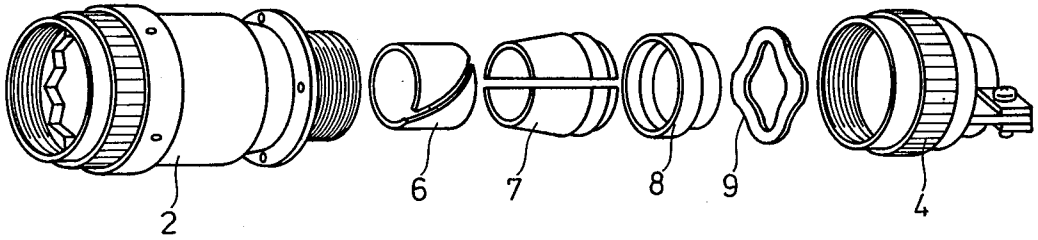
FIG. 6 is a perspective view of a still further illustrative embodiment of the invention.

FIGS. 4, 5 and 6 depict other illustrative embodiments of the invention, wherein FIG. 4 depicts an embodiment wherein ring 7 is an integral body having a single slit, FIG. 5 depicts an embodiment wherein ring 7 comprises three slit portions, and FIG. 6 depicts an embodiment wherein tube 6 has a spiral shaped slit.

The described nut abutting structure is not limited to the formation of the step at the inner periphery of cap nut 4; rather, it may also be attained by a stopper means disposed on the outer periphery of connector backshell 2 so as to regulate the progress of cap nut 4.

Advantageously, by the actions of the ring 7 and washer 8 which presses the split ring against the tapered surface 201, shield 201 is constantly brought into elastic contact with surface 201. Thus, even when a slight flaw is generated in shield 101 due to vibration or changes in temperature, backshell 2 is prevented from becoming loosened with respect to the cable and the shield 101 is reliably held in contact with the connector arrangement. Accordingly, the invention effectively prevents escape of electromagnetic radiation due to breaks in the shielding of the cable. Moreover, the invention is simple and inexpensive.

Tests were conducted on the invention to measure the following five items so as to verify the outstanding effects of the invention.

1. EMI . . . Evaluated in accordance with MIL-MIL-STD-461 method.
2. Lightening Strike . . . Evaluated in accordance with AIRBUS Spec.
3. Fire Resistance . . . Evaluated in accordance with MIL-W-25038E method.
4. Vibration . . . Evaluated by High Temperature Vibration Endurance Test at 150° C., 5–2000 Hz, 20 G for 30 hours.
5. Shell Conductivity . . . Maximum 5 milliohms between cable shield and connector through backshell. Shell Conductivity and Salt Spray Test evaluated in accordance with MIL-STD-1344 method.

NOTE: The high temperature vibration endurance test (150° C. vibration test-3 axes, 5 to 2000 Hz, 30 hours) was conducted on the entire backshell-connector structure to verify its durability. As a result, we found that the backshell retained its mechanical and electrical properties. Furthermore, after engine testings at two engine manufacturing firms, electrical harnesses were dismounted from the tested engines for inspection, and it was found that the average bonding resistance between the backshell and cable shield was 4 milli ohms. This value is significantly low to satisfy customer's requirements.

The foregoing description is illustrative of the principles of the invention. Numerous other modifications and extensions thereof would be apparent to the worker skilled in the art. All such modifications and extensions are to be considered to be within the spirit and scope of the invention.

What is claimed is:

1. A connector backshell structure comprising a connector backshell (2) having an open end provided with a tapered section on the inner periphery thereof and adopted to receive therethrough a cable (1) covered with a shield (101) so that the shield of the cable is peeled to be bent outwardly of the outer periphery of the cable and pressed against the tapered section of the connector backshell;

a ring means (7,6) for holding said shield in pressure contact with the tapered section of said backshell, said ring means comprising a tube (6) having a slit extending from one end thereof to another end thereof, and a wedge shaped ring (7) having at least one slit extending longitudinally along the entire length thereof, wherein said tube surrounds said cable, and said wedge shaped ring surrounds said tube;

a stepped ring (8) for seating said wedge shaped ring;

a spring washer (9) for elastically urging said stepped ring against said wedge shaped ring to urge said tube against said shield and a cap nut (4) for pressing and fixing said spring washer to the open end of said backshell.

2. The structure of claim 1, wherein said wedge shaped ring is split into at least three segments.

3. The structure of claim 1, wherein said wedge shaped ring has at least two slits.

4. The structure of claim 1, wherein said slit of said tube is spiral in shape.

5. The structure of claim 1, wherein said slit of said tube is a straight axially directed slit.

6. The structure of claim 1, further comprising a knitted means disposed on said cable at a position where said shield is peeled away from said cable.

* * * * *